US010525311B2

(12) United States Patent
Kolcun et al.

(10) Patent No.: US 10,525,311 B2
(45) Date of Patent: Jan. 7, 2020

(54) LEATHER GAME BALL COVER INCLUDING GHOSTED ALPHANUMERIC AND/OR GRAPHICAL INDICIA

(71) Applicant: Wilson Sporting Goods Co., Chicago, IL (US)

(72) Inventors: Daniel W. Kolcun, Chicago, IL (US); Ryan C. Ulrey, Ada, OH (US); Andrew J. Wentling, Carey, OH (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 15/982,957

(22) Filed: May 17, 2018

(65) Prior Publication Data

US 2018/0333616 A1 Nov. 22, 2018

Related U.S. Application Data

(60) Provisional application No. 62/507,906, filed on May 18, 2017.

(51) Int. Cl.

| | |
|---|---|
| ***A63B 41/08*** | (2006.01) |
| ***A63B 45/02*** | (2006.01) |
| ***A63B 41/02*** | (2006.01) |
| ***A63B 43/00*** | (2006.01) |

(52) U.S. Cl.

CPC ..... *A63B 41/08* (2013.01); *A63B 41/02* (2013.01); *A63B 43/008* (2013.01); *A63B 43/002* (2013.01); *A63B 45/02* (2013.01); *A63B 2243/007* (2013.01)

(58) Field of Classification Search

CPC ..... A63B 41/08; A63B 43/008; A63B 41/02; A63B 45/02; A63B 2243/007

See application file for complete search history.

(56) References Cited

U.S. PATENT DOCUMENTS

| | | | |
|---|---|---|---|
| 1,002,928 | A | 9/1911 | Pierce |
| 2,182,053 | A | 12/1939 | Reach |
| 2,194,674 | A | 3/1940 | Riddell |
| 2,859,040 | A | 11/1958 | Gow et al. |
| 2,906,533 | A | 9/1959 | Gow et al. |
| 2,866,644 | A | 12/1959 | Gow et al. |

(Continued)

FOREIGN PATENT DOCUMENTS

| | | |
|---|---|---|
| CN | 204547370 | 3/2015 |

*Primary Examiner* — Steven B Wong
(74) *Attorney, Agent, or Firm* — Terence P. O'Brien

(57) ABSTRACT

A game ball configured for direct contact with a user's hands includes a cover formed of a natural leather and having an outer surface. The outer surface of the cover includes a pebbled texture. The pebbled texture includes a plurality of spaced apart pebble-like projections extending from a base region. Each of the pebble-like projections has a pebble height measured from the base region adjacent to the pebble-like projection to a top surface of the pebble-like projection. At least a first portion of the cover includes alphanumeric and/or graphical indicia applied by a laser ghosting process, and a second portion of the cover is formed without the indicia. The average pebble height of a plurality of the pebble-like projections in the first portion of the cover is at least 80 percent of the average height of a plurality of the pebble-like projections in the second portion of the cover.

25 Claims, 13 Drawing Sheets

(56) References Cited

U.S. PATENT DOCUMENTS 2,931,653 A 4/1960 Gow et al.
4,000,894 A 1/1977 Butzen
4,660,831 A * 4/1987 Kralik ..... A63B 41/00 473/603
4,772,020 A 9/1988 Martin
4,928,962 A * 5/1990 Finley ..... A63B 41/08 473/596
5,069,935 A 12/1991 Walters
5,133,550 A 7/1992 Handy
5,248,878 A * 9/1993 Ihara ..... B44B 7/00 219/121.66
5,451,046 A 9/1995 Batton
5,523,125 A * 6/1996 Kennedy ..... A63B 45/02 427/155
5,570,882 A 11/1996 Horkan
5,770,325 A * 6/1998 Keller ..... A63B 45/02 428/187
D411,269 S 6/1999 Albarelli, Jr.
5,990,444 A 11/1999 Costin
6,238,847 B1 * 5/2001 Axtell ..... B41M 5/262 427/555
6,252,196 B1 6/2001 Costin et al.
D453,036 S * 1/2002 Frisina ..... D21/712
6,462,303 B1 * 10/2002 Brown ..... A63B 45/02 219/121.69
6,576,862 B1 6/2003 Costin et al.
6,629,902 B2 10/2003 Murphy et al.
6,685,868 B2 2/2004 Costin
6,767,300 B2 7/2004 Murphy et al.
D504,709 S * 5/2005 Chang ..... D21/712
7,029,407 B2 4/2006 Lee et al.
7,258,909 B2 * 8/2007 Akamata ..... D06N 3/0075 428/131
D570,431 S 6/2008 Krysiak
D570,432 S 6/2008 Krysiak
D570,931 S 6/2008 Krysiak
D584,778 S * 1/2009 Bevier ..... D21/712
7,699,896 B1 4/2010 Colwell
8,047,937 B2 11/2011 Krysiak
8,142,311 B2 3/2012 Krysiak
8,366,574 B2 2/2013 Guenther et al.
8,371,971 B2 2/2013 Bevier
8,449,417 B2 5/2013 Bevier et al.
8,460,135 B2 6/2013 Guenther et al.
8,512,177 B2 8/2013 Krysiak et al.
8,579,742 B2 11/2013 Krysiak
8,905,876 B2 12/2014 Guenter et al.
8,921,732 B2 12/2014 Costin et al.
9,364,920 B2 6/2016 Costin et al.
9,629,271 B1 * 4/2017 Lancaster-Larocque ..... B24C 1/06
2006/0046879 A1 * 3/2006 Kelly ..... A63B 41/08 473/603
2006/0211527 A1 * 9/2006 Guenther ..... A63B 41/08 473/597
2007/0178997 A1 8/2007 Chang
2008/0287230 A1 11/2008 Guenther et al.
2013/0260927 A1 * 10/2013 Thurman ..... A63B 41/08 473/595
2014/0256478 A1 9/2014 Gale

* cited by examiner

LEATHER GAME BALL COVER INCLUDING GHOSTED ALPHANUMERIC AND/OR GRAPHICAL INDICIA

RELATED U.S. APPLICATION DATA

The present application is a non-provisional application claiming priority from U.S. Provisional Patent Application Ser. No. 62/507,906 filed on May 18, 2017 by Kolcun et al. and entitled LEATHER GAME BALL COVER INCLUDING GHOSTED ALPHANUMERIC AND/OR GRAPHICAL INDICIA, the full disclosure of which is hereby incorporated by reference.

FIELD OF THE INVENTION

The present invention relates generally to a leather game ball. In particular, the present invention relates to applying alphanumeric and/or graphical indicia via a ghosting process to the surface of a leather game ball.

BACKGROUND OF THE INVENTION

Inflatable game balls, such as footballs, basketballs, volleyballs and soccer balls, are well known and typically include an inner inflatable air bladder and an outer cover. The cover can be formed of one or more cover panels. The outer cover of footballs and other types of game balls also typically include trademarks, symbols and logos. Leather game balls have existed for several decades. In football and basketball, as in many other sports, the gripping and tactile characteristics of the ball can considerably affect the performance of the participating players. In particular, the tactile characteristics of the outer surface of the game ball significantly effect the player's ability to catch, pass or otherwise control the ball accurately and reliably.

Many existing leather game balls use lasers or branding techniques to add indicia to the outer surface of the leather game balls. Such existing techniques for applying indicia to the outer surface of leather game balls have the effect of making the outer surface of the cover panel less grip-able or more slippery at these locations. When a cover panel undergoes a conventional laser, branding or other thermal and/or chemical process to apply indicia, the outer surface of the leather game ball is typically burnt, damaged and/or otherwise destroyed, these damaged areas typically are far more slippery or significantly less grip-able than regions of the leather game ball cover that has not undergone such damaging process. Accordingly, existing leather games balls having indicia that is applied to the outer surface of the ball through laser techniques, branding or other thermal applications typically result in severely reducing the performance characteristics of the leather game balls at the locations of the indicia, in particular a player's ability to grip, pass, catch, hold, control, shoot and/or handle the leather game ball.

In an effort to avoid the destructive laser, branding or other thermal techniques, in many instances labels or decals are applied over the outer surface of the leather game ball. The use of additional labels and/or decals typically results in similar reduction in the grip-ability of the leather game ball. The additional labels and/or decals can add to the cost of the ball. Further, many such labels and/or decals can peel, flake, or wear away over time.

Due to the many negative characteristics of applying graphical and/or alphanumeric indicia to the outer surface of a leather game ball as discussed above, the use of such indicia is typically minimally applied to the outer surface of the ball. Typically, such indicia is only applied to a portion of the cover, or just to a portion of one or two cover panels thereby limiting the surface area of the game ball that includes the indicia.

Thus, there is a need for applying alphanumeric and/or graphical indicia to the outer surface of a leather game ball that does not negatively affect the performance, grip and/or playability of the leather game ball. What is needed is a technique to apply such indicia to the outer surface of a leather game ball in a manner that is durable and does not add significant additional cost to the production of the leather game ball. What is needed is a technique for applying alphanumeric and/or graphical indicia to the outer surface of a leather game ball that does not alter or improves the gripping and tactile characteristics, or frictional interaction with the hands of a user, without deviating or radically departing from the ball's traditional design and organized play equipment requirements.

DETAILED DESCRIPTION OF THE PREFERRED IMPLEMENTATIONS

Figure 1:
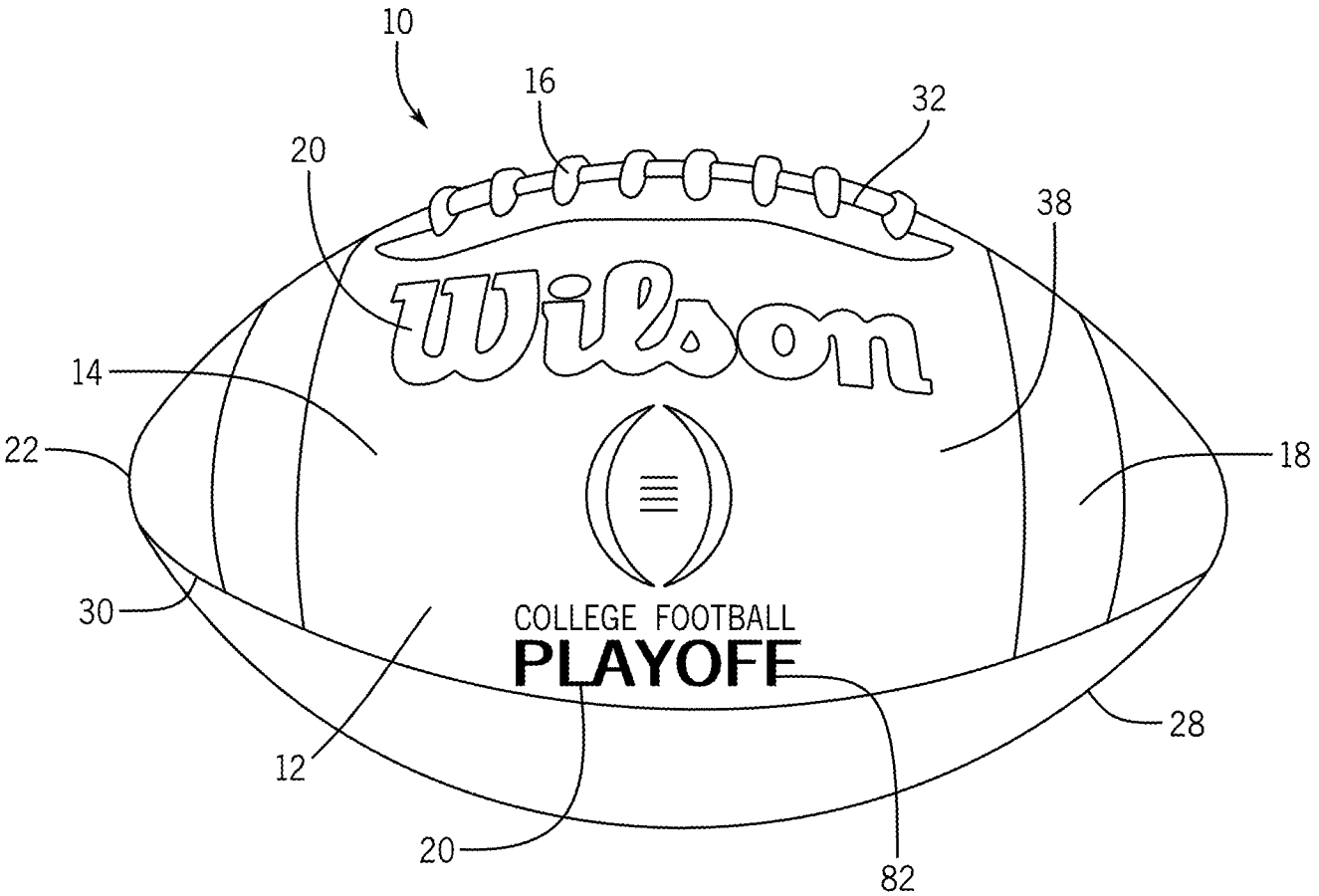
FIG. 1 is a top, side perspective view of an American-style football in accordance with an example implementation of the present invention.
Figure 2:
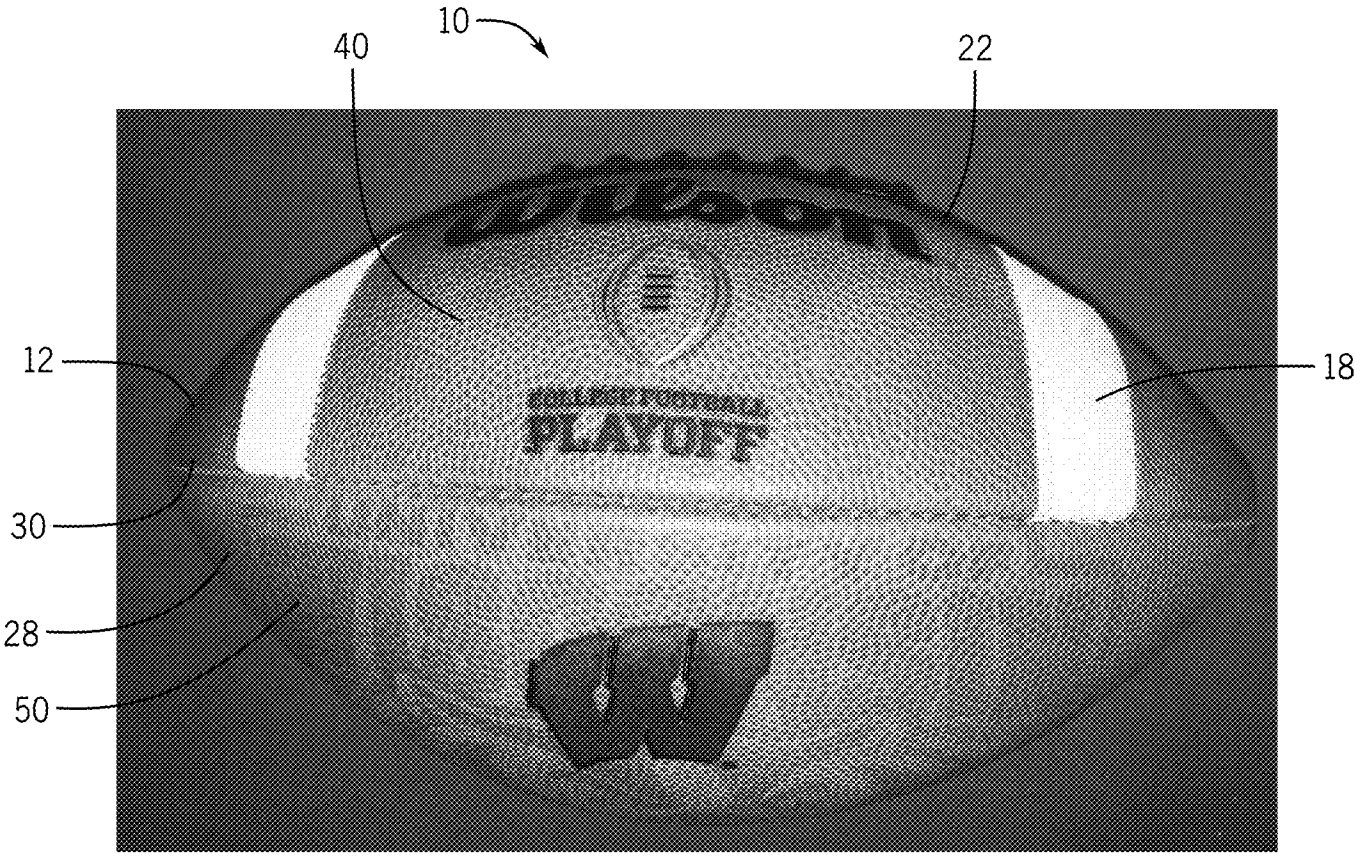
FIG. 2 is a side perspective view of the football of FIG. 1.

Referring to FIGS. 1 through 4, an American football is indicated generally at 10. The football 10 is one example of an inflatable leather game ball. The present invention is also directly applicable to other inflatable game balls, such as, for example, basketballs, volleyballs, soccer balls and rugby balls. The game balls are configured to be contacted directly by the hands of one or more users, although the game balls can also be used by one or more gloved users.

The football 10 is a generally prolate spheroidal-shaped inflatable object having a major longitudinal dimension and a minor transverse dimension. The football 10 includes a cover 12, an inflatable bladder 14, a lacing 16, a plurality of stripes 18 and a plurality of logos 20. The cover 12 is a prolate spheroidal-shaped outer body preferably formed from first, second, third and fourth cover panels 22, 24, 26 and 28 that are joined to one another along longitudinal seams 30. The longitudinal seam 30 connecting the first and second cover panels 22 and 24 includes a longitudinally extending slot 32. In one implementation, the football 10 also includes a lining (not shown) that is a layer of strong, durable material positioned over the inflatable bladder 14 and beneath the cover panels 22, 24, 26 and 28. The second cover panel 24 includes a valve aperture 34 for receiving a valve 36 of the bladder 14. In alternative preferred implementations, the cover 12 can be formed of a single piece or of two, three, five or other numbers of cover panels. The cover 12 provides the ball 10 with a durable and grippable outer surface.

The cover 12 is made of leather from animal rawhide and skin such as, for example, calf leather, lamb leather or pig leather. Every piece of leather is unique. The quality and characteristics of leather vary from animal to animal, and from locations on the same animal. Some leather samples, even from the same animal, can be stronger and more durable than other samples. Some leather samples may be stiffer and other samples may be more flexible or resilient. Some leather samples may have a softer feel than others may have a harder feel. For example, leather taken from the shoulder or spine areas of calves can be considered to be of a higher quality than leather taken from other locations on calves due to the softness, thickness, durability of the rawhide and/or skin. Leather undergoes a tanning process whereby the skin and hides of animals are processed to add color as desired, and to make the skins/hides more durable and less susceptible to decomposition. In the case of leather game balls, such as footballs, the leather can also be processed to include a pebbled texture.

An outer surface 38 of the cover 12 or cover panels 22, 24, 26 and 28, preferably includes a pebbled texture for enhancing the grip and improving the aesthetics of the football 10. The pebbled texture includes a plurality of pebble-like prominences or projections 40 that are preferably convex, rounded and spaced apart from one another. The term "pebbled texture" refers to a surface having a plurality of the projections 40 separated by valleys or indentations. As discussed further below, the pebble-like projections 40 can take a variety of different shapes. The area between the spaced apart projections 40 is a base area or a series of valleys 80. The pebble-like projections 40 extend outward from the base area or valleys 80. In one implementation, the pebble-like projections 40 have a height, measured with respect to adjacent valleys or indentations, within the range of 0.1 to 0.7 mm (0.004 to 0.0275 inch). In another implementation, the pebble-like projection 40 have a height, measured with respect to adjacent valleys or indentations, within the range of 0.17 to 0.5 mm (0.0067 to 0.0197 inch). In another implementation, the pebble-like projections 40 have a height, measured with respect to adjacent valleys or indentations, of at least 0.006 inch.

The cover 12 is configured to surround and enclose the internal components of the football 10, which in one implementation can include the bladder 14 and the lining. In other implementations, the internal components can include the bladder, the valve, a layer of windings, a layer of molded rubber, a padding layer, the lining or combinations thereof. The slot 32 between the first and second cover panels 22 and 24 is used for allowing the bladder to be inserted within the cover panels during manufacture. The lacing 16 retains the first and second cover panels 22 and 24 and closes the slot 32. The lacing 16 also provides raised surfaces for a player to contact when passing, catching or holding onto the football 10. In another implementation, the cover 12 can be formed without a slot between two adjacent cover panels.

The plurality of logos 20 can includes trademarks, symbols or other forms of alphanumeric and/or graphical indicia, such as for example, the "WILSON®" trademark. In one implementation, the logos 20 are formed form one or more layers of decals, foils, coatings, stickers, or overlays that is/are applied to the outer surface 38 of the cover 12. The logos 20 can be attached to the cover 12 through an adhesive, thermal bonding, chemical bonding or other conventional application techniques. In another implementation, the logos 20 can be applied using a branding, laser or other destructive technique that forms the logo 20 by burning, burning off, melting away or otherwise destroying the outer surface 14 of the cover 12 to form one or more recesses in the cover 12. Both forms of logos 20, those applied as an additional layer or those destructively formed into the outer surface of the cover 12 both alter the outer surface 14 of the cover 12. Typically, the ball 10 containing logos 20 is less grip-able in the location of the logo 20. In some instances, a decal or overlay applied to the outer surface of the ball 10 can provide a similar or even improved grip-ability to the ball. However, such decals or overlays can increase the cost, the manufacturing complexity, the weight, and/or the balance of the ball 10, and can also prematurely wear or peel reducing the durability and aesthetics of the ball 10.

As stated above, logos 20 that are applied via laser, branding or other thermal bonding techniques generally include destroying, removing and/or compressing the portion of the cover panel to which such logos 20 are applied. Such laser, branding or thermal bonding logos 20 create recesses 82 within the outer surface 38 of the cover panel 22. The recesses can have a depth of at least 0.005 inch. One example of such a recess is the indicia labeled "COLLEGE FOOTBALL PLAYOFF" on cover panel 22. Applicant has measured the depth of recesses caused by laser application of logos and thermal bonding or branding techniques. Applicant worked with Assurance Technologies, Inc. ("ATI") of Bartlett, Ill., an accredited lab that provides calibration services, dimensional inspection services, and testing services, to measure the depth of such logos applied to a cover panel of a football. ATI utilized a Micro Vu Excel Automated Vision Measuring Machine produced by Micro-Vu Corporation of Windsor, Calif. to measure the depth of the recesses formed by such logos. Measurements of three separate laser applied and thermal branding logos was taken and the depth measured with respect to the base or valley 80 was 0.00803, 0.00935 and 0.00987 with an accuracy within 0.00009 inch. Accordingly, logos 20 produced via a conventional laser or via thermal bonding or branding create recesses 82 that extend into the cover panel 22 below the level or relative height of the valleys 82 between the pebble-like projections 40 of at least 0.005 inch. The recesses 82 extend inward from the valleys 80 and the pebble-like projections 40 project outward (in an opposite direction) from the valleys 80.

Figure 3:
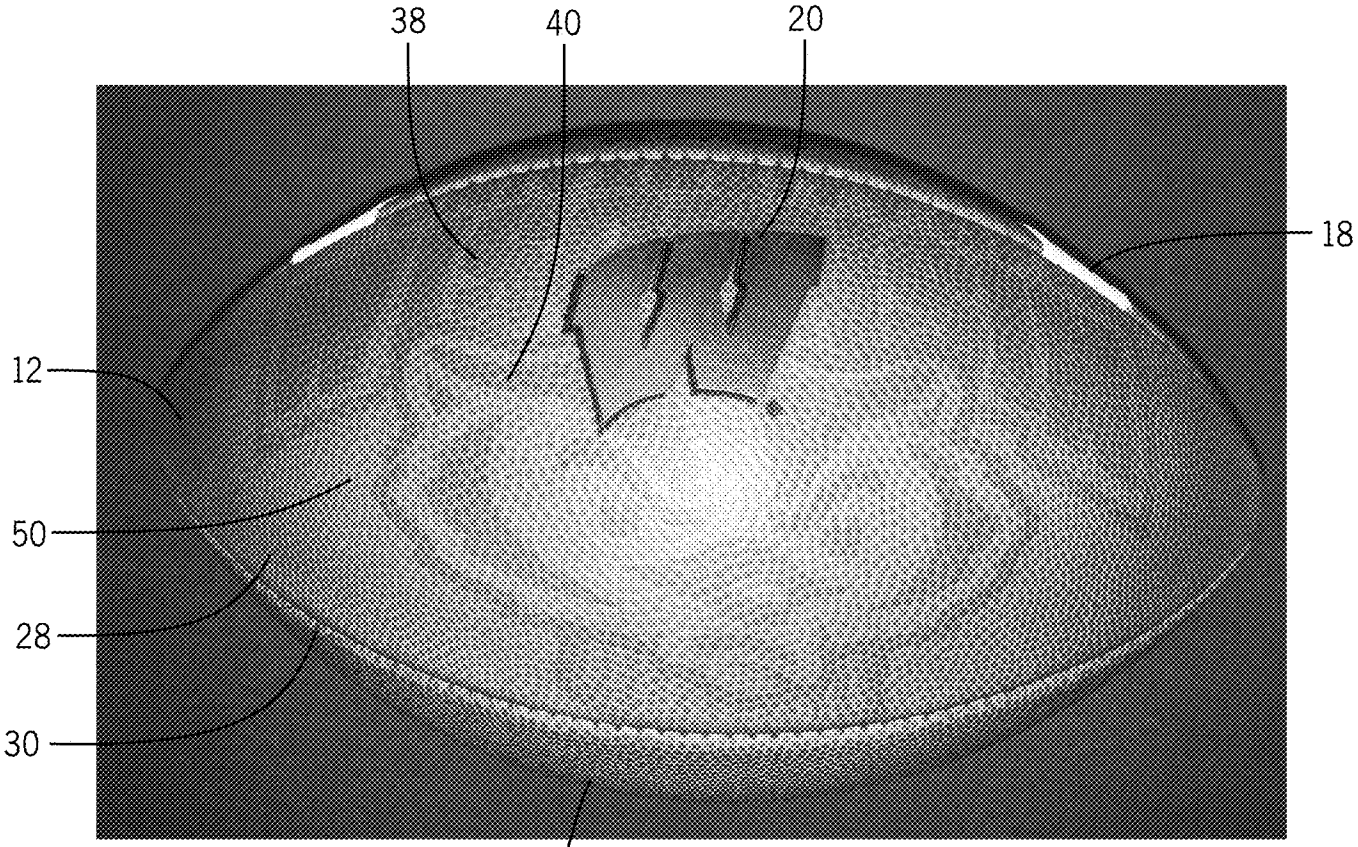
FIG. 3 is a bottom, side perspective view of the football of FIG. 1.
Figure 4:
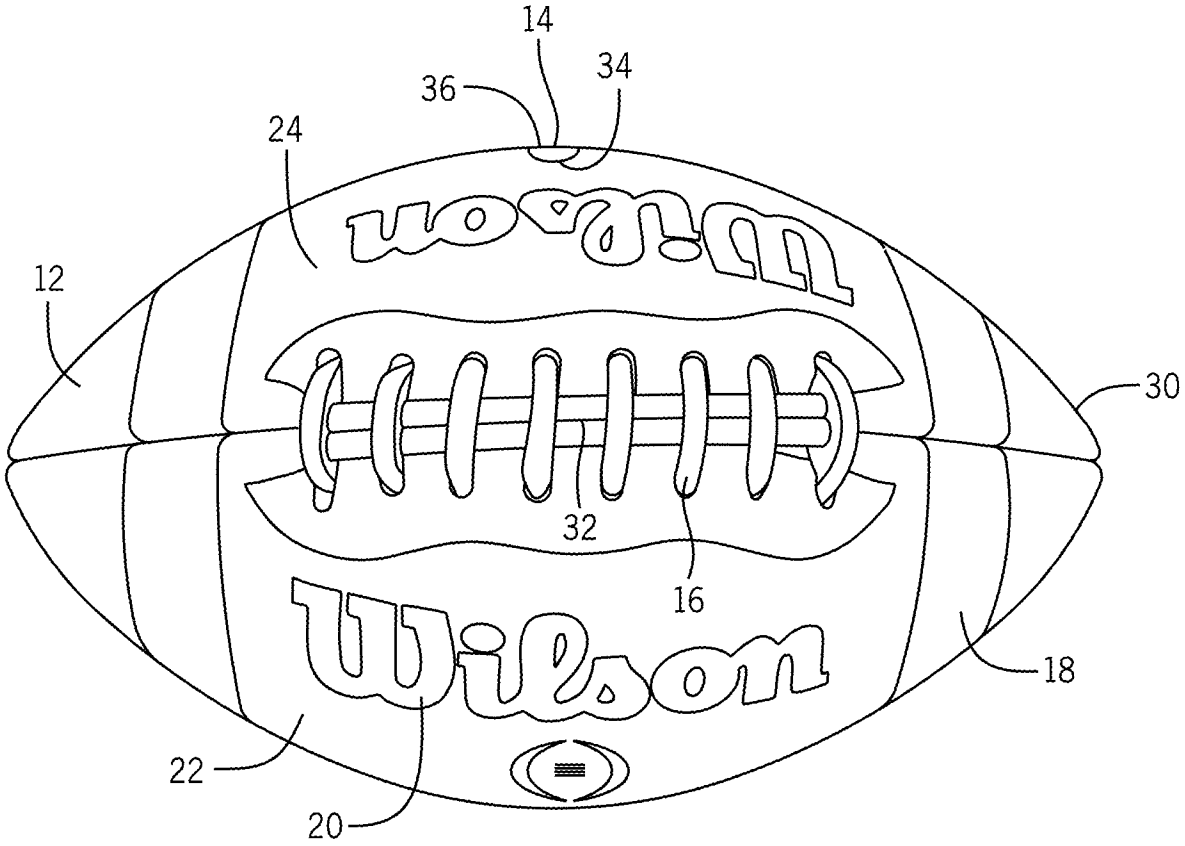
FIG. 4 is a top view of the football of FIG. 1

Referring to FIG. 3, the inventors have identified a laser ghosting process that enables alphanumeric and/or graphical indicia, such as indicia 50, to be applied to the outer surface 38 of the cover 12 without negatively affecting the performance, playability, grip-ability, durability and/or reliability of the ball 10. Laser treatment of surface materials is known and involves essentially burning or destroying the surface of the material receiving the laser treatment. Lasers have been used on footballs in the past and such laser action involves burning or destroying the outer surface of the leather including burning away or destroying any pebble-like projections that may be originally present on the leather material prior to application of the laser treatment. As stated above, conventional laser techniques for applying indicia to a leather game ball creates recesses that inwardly extend into the cover from the outer surface of the ball directly adjacent to the location where the conventional laser was applied.

Accordingly, given the well-known destructive nature of laser treatment, one of skill in the art would not consider the use of lasers to form indicia on the surface of a leather ball in a manner that would not negatively alter the performance characteristics of the leather ball. Leather footballs have existed for many decades, and leather footballs have also been subjected to laser treatment to burn in logos or other indicia for decades. Contrary to conventional practice, the inventors began an extensive effort to explore other potential uses of laser treatment. After significant effort and numerous failures, the inventors identified and discovered a laser ghosting process that enables indicia 50 to be applied to the outer surface 38 of a cover of a leather ball having pebble-like projections that does not negatively affect the performance characteristics of the football including grip-ability and playability. The laser ghosting process can be applied to the outer surface 38 of the leather cover 12 having the pebble-like projections 40 without negatively altering the grip-ability, playability, performance, reliability or durability of the ball 10. The ghosting process enables virtually any form of alphanumeric and/or graphical indicia 50 to be applied to the outer surface 38 of the leather cover 12 without increasing the weight of the ball 10, without affecting the balance of the ball 10, and without affecting the performance of the football. The laser ghosting process involves a specific low power application of laser energy to the outer surface 14 of the ball 12 that creates a change in the color of the outer surface 14 but does not negatively affect the performance characteristics of the outer surface 14 including the static coefficient of friction values of the outer surface (which correlates to the grip-ability of the ball) and/or the height of the pebble-like projections on the outer surface. The inventors have identified that in one implementation, the ghosting process for applying the indicia to the outer surface 38 of the cover 12 of the ball 10 does not alter the height of the pebble-like projection 40 when comparing the pebble-height in areas that did not receive the laser ghosting process versus areas that did receive the laser ghosting process. In other implementations, the inventors have identified that the laser ghosting process reduces the height of the pebble like projections 40 by less than 10 percent. In another implementation, the inventor have identified that the laser ghosting process reduces the height of the pebble-like projections 40 by less than 5 percent when compared to regions of the cover panel that did not receive the laser ghosting process. As such, inventors have identified that the grip-ability and therefore the ability of a player to hold, grab, retain, pass, throw, pitch, lateral, catch and run with the ball 10 is not affected or significantly reduced by application of the laser ghosting process.

Figure 5:
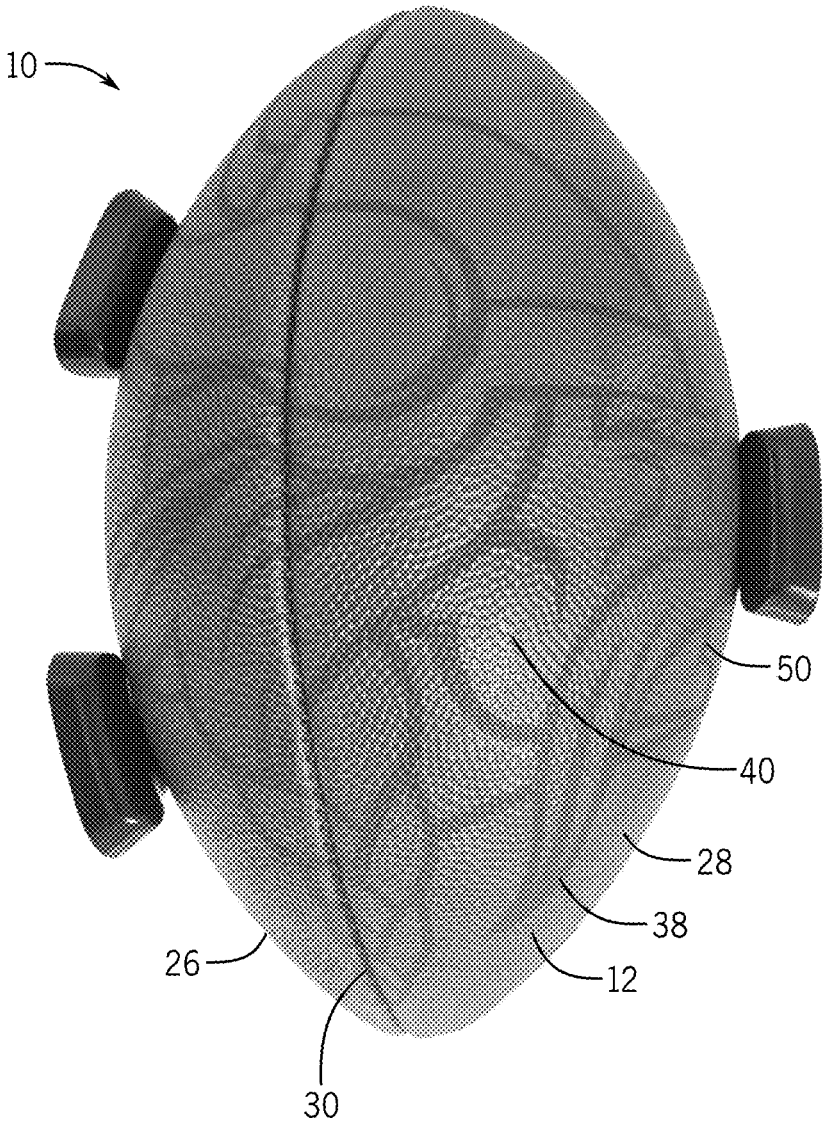
FIG. 5 is a bottom perspective view of an American-style football in accordance with another example implementation of the present invention.
Figure 6:
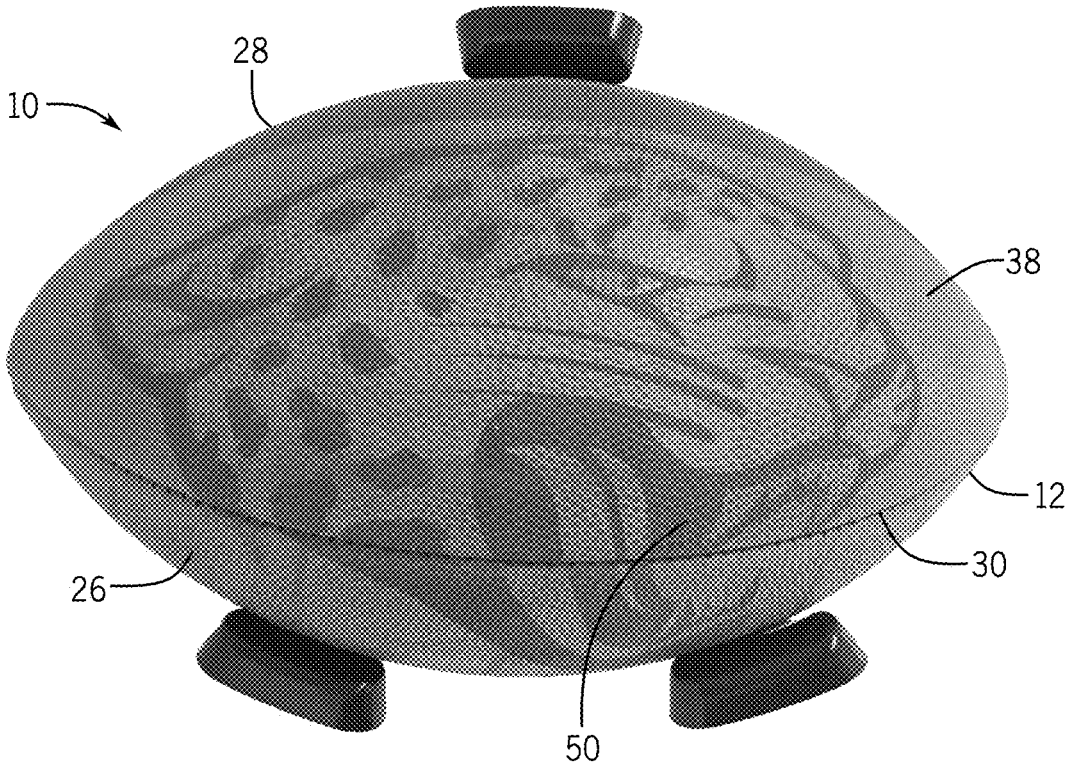
FIG. 6 is a bottom perspective view of an American-style football in accordance with another example implementation of the present invention.

Referring to FIGS. 5 and 6, other example implementations of indicia 50 applied to the outer surface 38 of the cover 12 (and cover panels 26 and 28) having the pebble-like projections 36 of the ball 10 using the laser ghosting process are shown. FIGS. 3, 5 and 6 illustrate the variety of indicia 50 that can be applied to the leather cover 12 having pebble-like projections 36. The indicia 50 can be alpha characters, such as "UNIVERSITY OF WISCONSIN", a logo, such as "Bucky the Badger", or an image. The indicia 50 can vary in size and shape, and can be continuous or spaced apart about the outer surface 14 of the leather cover 12. The cover 12 as a whole, and each of the cover panels 26, 28, 22 and 24 has outer surface areas. The indicia 50 can be applied to a first portion of the cover 12 or to one or more of the cover panels 26, 28, 22 and 24. In one implementation, the alphanumeric and/or graphical indicia 50 extends over at least one third (33%) of the outer surface area of at least one of the cover panels 26, 28, 22 or 24. In another implementation, the alphanumeric and/or graphical indicia 50 extends over at least one half (50%) of the outer surface area of at least one of the cover panels 26, 28, 22 or 24. Further, in another implementation, the alphanumeric and/or graphical indicia 50 extends over at least two-thirds (66%) of the outer surface area of at least one of the cover panels 26, 28, 22 or 24. In other implementations, the indicia 50 can extend over at least 75% or 90% of the outer surface area of the cover panels 26, 28, 22 or 24. Additionally, in other implementations, the indicia 50 can extend over two or more of the cover panels 22, 24, 26 and 28, and the indicia can extend over at least 25%, 33%, 50%, 66% or 75% of the outer surface area of the cover 12 as a whole.

Figure 7:
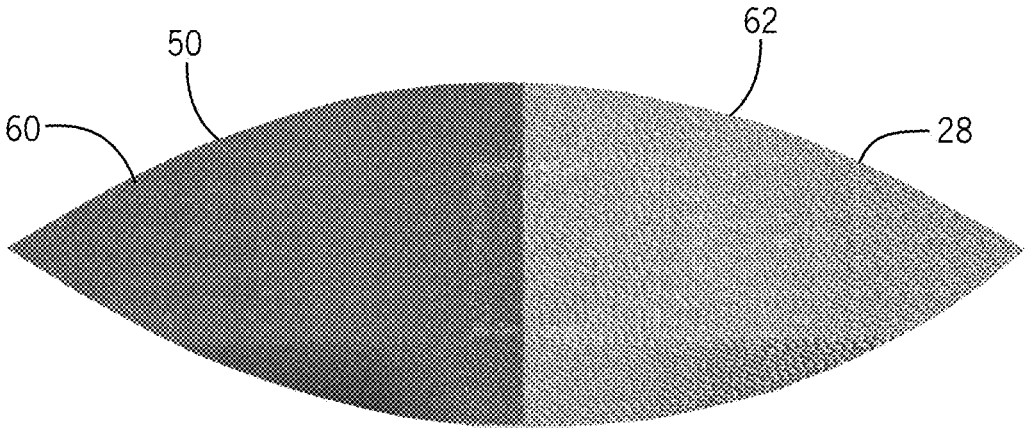
FIG. 7 is a top side perspective view of a leather cover panel of the first color of a football with one half of the cover panel treated with a laser ghosting process and the other half of cover panel untreated by the laser ghosting process.
Figure 8:
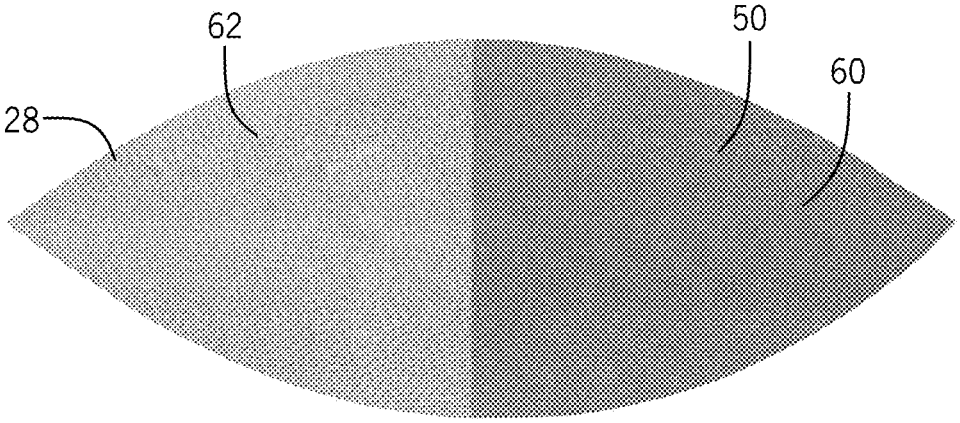
FIG. 8 is a top side perspective view of a leather cover panel of the second color of a football with one half of the cover panel treated with a laser ghosting process and the other half of cover panel untreated by the laser ghosting process.

Referring to FIGS. 7 and 8, the laser ghosting process is shown being applied to one half of two separate leather cover panels 28, such that a first portion 60 of the cover panel 28 is treated with the laser ghosting process to form a solid pattern of the indicia 50 over one half of the cover panel 28, and a second portion 62 of the cover panel 28 is formed without the indicia and without any laser ghosting treatment. The leather cover panel 28 of FIG. 7 is formed of a first color or pigment, and the leather cover panel 28 of the FIG. 8 is a second color or pigment, that is different and lighter than the first color. The half and half ghosting pattern of FIGS. 7 and 8 was utilized when preparing test specimens for measuring the performance characteristics of the first portion 60 of one of the cover panels 28 compared to the second portion 62. Obtaining two test specimens from the same cover panel 28 helps to reduce or eliminate the variability between pieces of leather (animal to animal, and location to location on a particular animal). Here, the first portion 60 that received the laser ghosting process is compared with the second portion 62 that is formed without the laser ghosting process. Therefore, the source leather for each pair of test specimens is prepared from the same leather sample from the same animal and the same location on the animal.

Figure 9:
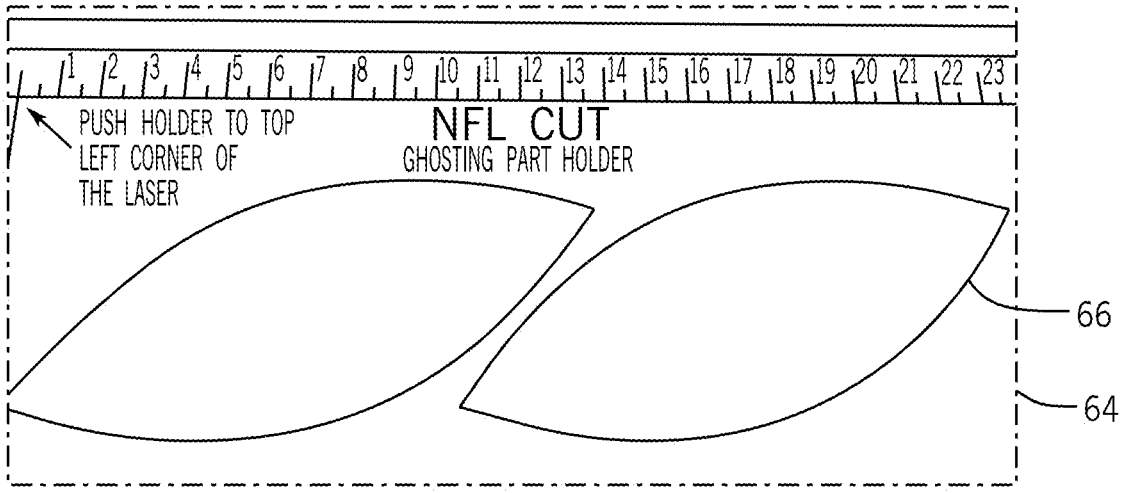
FIG. 9 is a top view of a template for receiving a pair of leather cover panels for use during a laser ghosting process.
Figure 10:
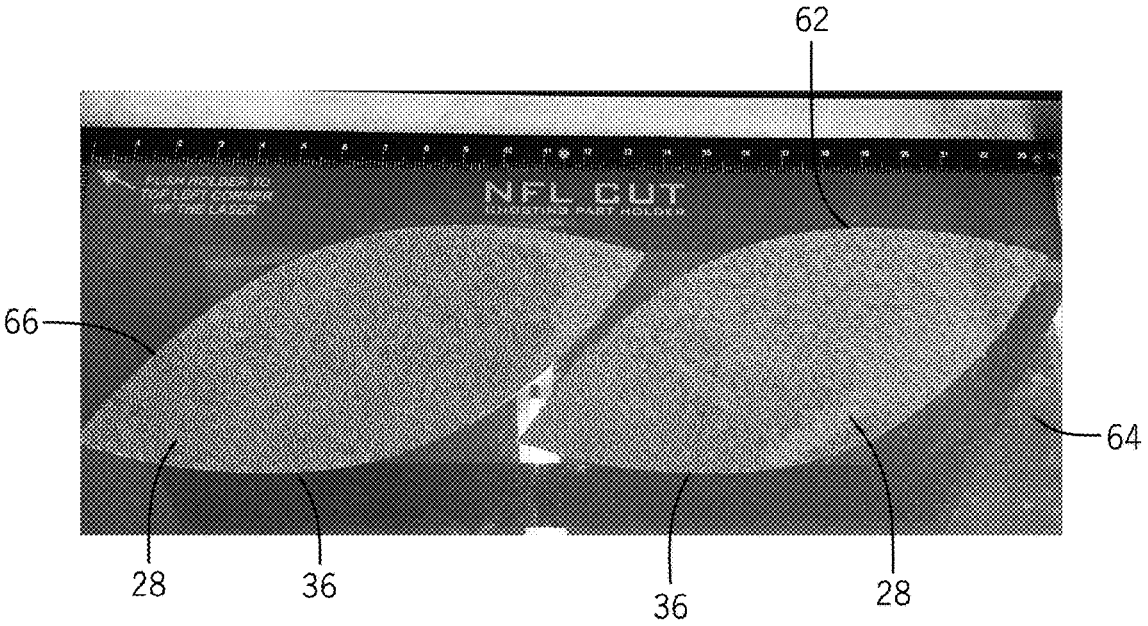
FIG. 10 is a top view of the template of FIG. 9 with two untreated leather cover panels inserted within the template.
Figure 11:
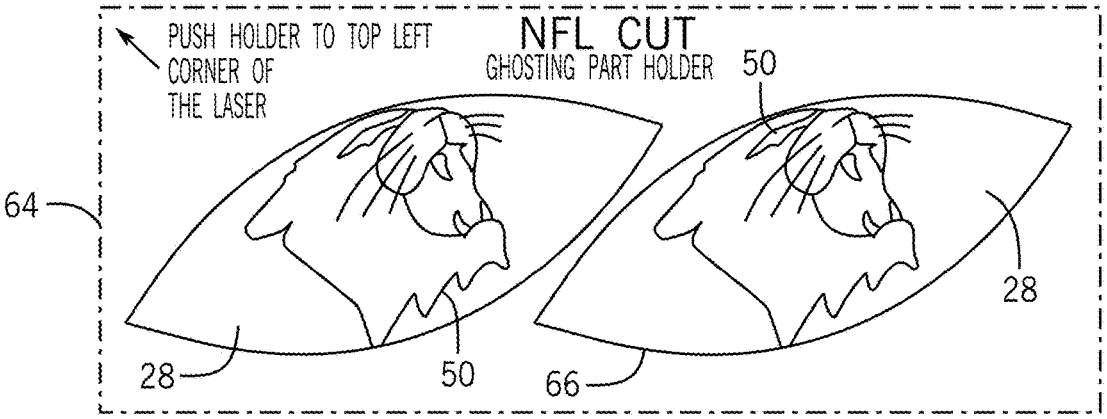
FIG. 11 is a representation of graphical indicia to be applied to the pair of leather cover panels of FIG. 10.

FIGS. 9 through 11 illustrate a template 64 for receiving and retaining a pair of the leather cover panels 28 during digital laser material processing. The template 64 includes two cover panel recesses 66 for receiving the pair of cover panels 28. The template 64 is configured for use with a laser platform such as laser platform model VLS3.60 produced by Universal Laser Systems of Scottsdale, Ariz. FIG. 9 illustrates the template 64 prior to receiving the pair of cover panels 28. FIG. 10 illustrates the template 64 with the pair of cover panels 28 positioned within the recesses 66 of the template 64, prior to application of the laser ghosting process. FIG. 11 illustrates the template 64 with the pair of cover panels 28 including indicia 50 applied to the pair of cover panels 28 by the laser ghosting process using the laser platform.

Figure 12:
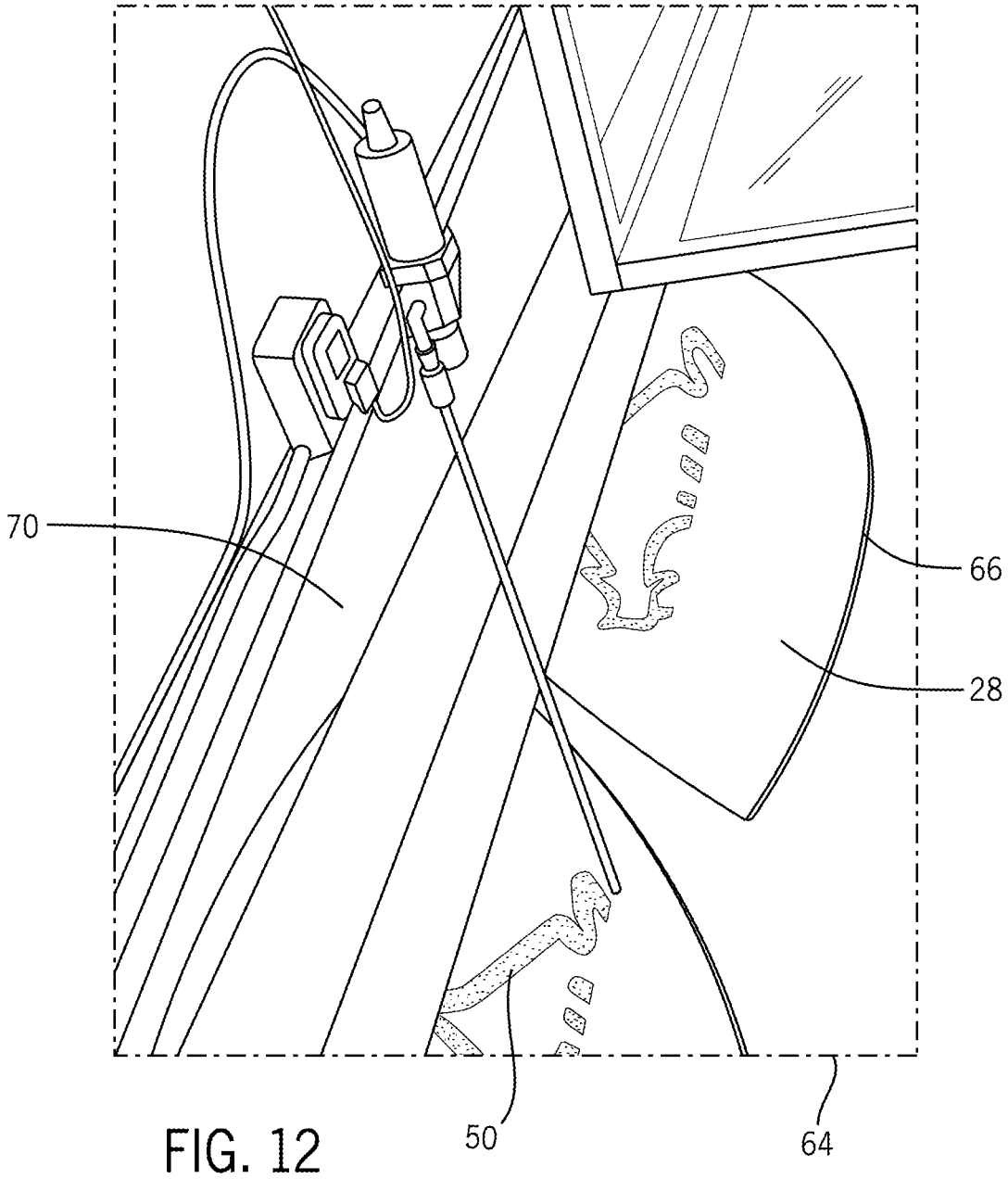
FIG. 12 illustrates the application of the graphical indicia shown in FIG. 11 on to the pair of cover panels of FIG. 10 during the laser ghosting process using digital laser material processing.

FIG. 12 is an image of the laser ghosting process being applied to the pair of cover panels 28 positioned within the template 64. The laser ghosting process includes use of a laser, such as a 30 Watt $CO_2$ laser source, operating in a rastering mode in which a laser control head (or stylus) 70 travels at a speed of 50 in/sec at a power level of 25 percent. In one implementation, a 25 percent power level refers to the application of laser energy 30 Watt energy source at 25 percent time frame or duration. In another implementation, the 35 percent power level can refer to a 7.5 Watt power source. In one implementation, the laser control head 70 travels at a speed within the range of 40-60 in/sec and the power level is within the range of 20 to 30 percent. The image density setting can be set at a setting of 1 on the Universal Laser System, model VLS 3.60, and the pulses per inch (PPI) can be set to 150 PPI. In one implementation, the distance from the laser control head to the outer surface 38 of the cover panel 28 is within the range of 0.070 and 0.090 inch. In one implementation, the distance from the laser control head 70 to the outer surface 38 of the cover panel 28 is 0.080 inch. The distance from the laser control head 70 to the outer surface 14 of the control panel 28 can be set using a focus tool, whereby the distance is adjusting until the desired focus area or beam area is achieved.

Figure 13:
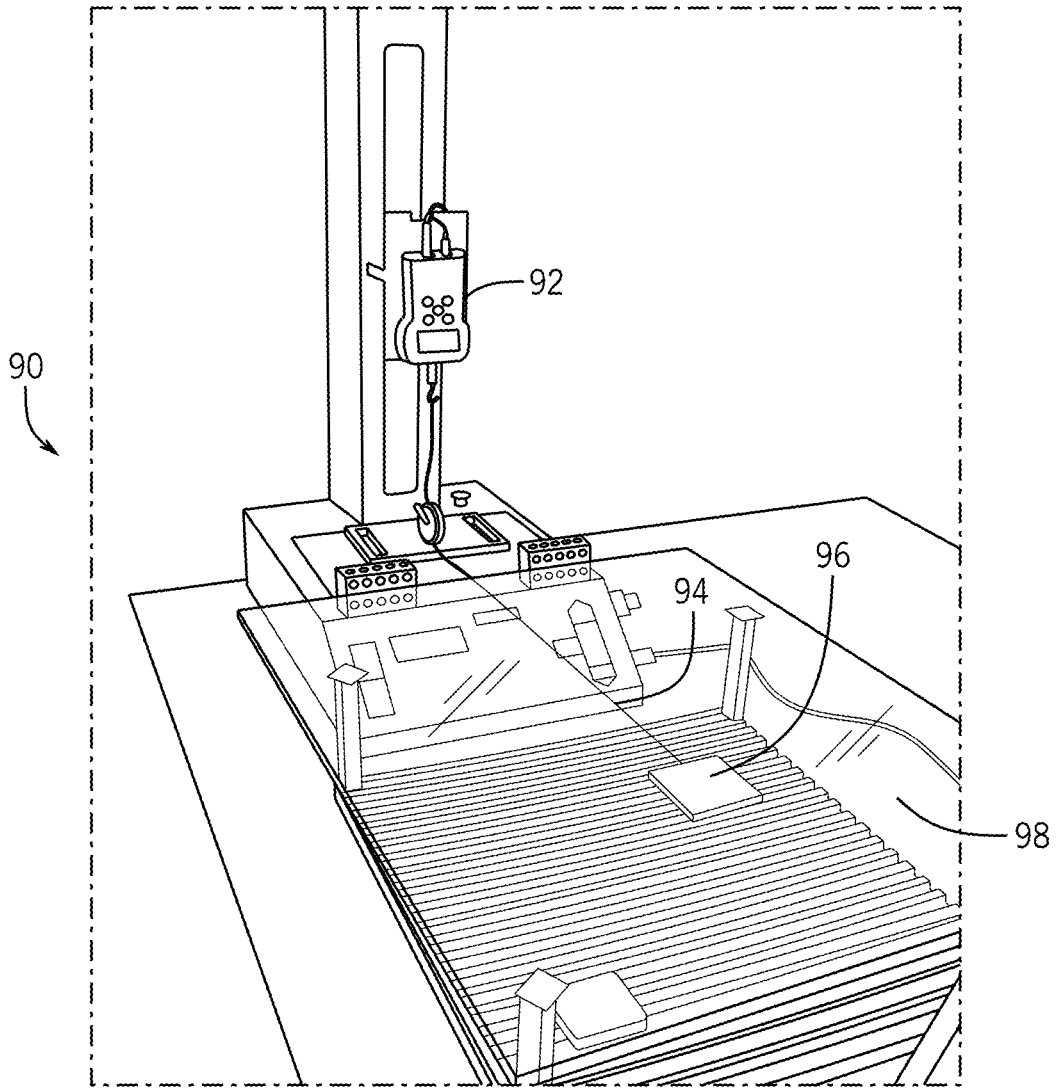
FIG. 13 is a top side perspective view of a test set up for conducing static coefficient of friction tests of leather cover panels sections.

The cover panels 28 of FIGS. 7 and 8 and other similarly treated cover panels were used to obtain test specimens for the measurement of the coefficient of friction of the first and second portions 60 and 62 of the cover panels 28. The test specimens prepared from the first and second portions 60 and 62 can be tested under ASTM Standard D 1894 entitled "Standard Test Method for Static and Kinetic Coefficients of Friction of Plastic Film and Sheeting" promulgated by ASTM International located at 100 Barr Harbor Drive, West Conshohocken, Pa. 19428-2959. FIG. 13 illustrates an example test setup 90 for performing the static coefficient of friction measurement under ASTM Standard D1894. The ASTM Standard D1894 includes versions -01 and -14, and the ASTM Standard D1894 tests the static coefficient of friction of a material (or the test specimen). The static coefficient of friction value correlates to the grip-ability or grip quality of the surface being tested.

In accordance with ASTM Std. D 1894-14, material samples or specimens are preferably trimmed to 2.5" width× 2.5" length (or 2.5 inches by 2.5 inches). A metal sled 96 is used having a size of approximately 2.5" length×2.5" width× 0.25" thickness. The bottom of the sled 96 is lined with a high density foam (having a nominal density of 0.25 g/cm$^3$), and the material specimens are attached to the bottom of sled with for example, a double faced tape. Prior to testing, the sled 96 is weighed. A plane or runway 98 formed of glass is also used, which is placed on to a supporting base. The runway 98 is cleaned with isopropyl alcohol and dried with a soft, lint-free cloth. The sled 96 with the specimen from the portion 60 or the portion 62 is pulled by a pulling device 92 and a cord 94 of a fixed length across the runway 98 at a speed of 152.4 mm per minute for a total distance of 200 mm. The initial force to start sled movement and the average force from the 25 mm distance to the 175 mm distance is recorded. The pulling device 92 can include force measuring device is capable of measuring frictional force to +/−5% of its value. The force measuring device can be a spring gage, a universal testing machine, or a strain gage. The sled weight is then divided into the force values (force values divided by the sled weight) to obtain the Static and Kinetic Coefficient of Friction values at the respective sled positions.

In an independent test conducted by ATI of Bartlett, Ill., Applicants obtained static coefficient of friction values in accordance with ASTM Standard No. D1894-14, and as described above, for cover panel portions treated with the laser ghosting process and cover panel portions not treated with the laser ghosting process. A total of 12 test skids 96 with separate test specimens on each skid 96 were prepared. The 12 separate test specimens were obtained from three separate cover panels 28 of a first color and three separate cover panels 28 of a second color.

In this case, three of the cover panels 28 of the first color were of the same leather used to produce the Wilson® NFL® Official Football ("Pro Samples"). Each of these three Pro Sample cover panels were used to produce three specimens from the first portions 60 (which have been treated with the laser ghosting process), and three specimens from the second portions 62 (which were not treated with the laser ghosting process). Accordingly, the three Pro Samples were used to produce three pairs of test skids 96 and test specimens with each pair of test specimens coming from the same Pro Sample cover panel 28 (one of the pair being treated with the laser ghosting process, and the other of the pair being untreated with the laser ghosting process). Additionally, another three of the cover panels 28 of the second color were of the same leather used to produce the Wilson® GST® Footballs ("GST Samples")—a football configured for college games. Each of these three GST Sample cover panels were used to produce three specimens from the first portions 60 of the GST Sample cover panels (which have been treated with the laser ghosting process), and three specimens from the second portions 62 of the GST Sample cover panels (which were not treated with the laser ghosting process). Accordingly, the three GST Samples were used to produce three pairs of test skids 96 and test specimens with each pair of test specimens coming from the same GST Sample cover panel 28 (one of the pair being treated with the laser ghosting process, and the other of the pair being untreated with the laser ghosting process). In addition to the 12 test skids 96 with leather test specimens, another skid was prepared with a smooth piece of glass used in place of a leather test specimen The results identified from testing the static coefficient of friction of 12 leather cover panel test specimens and one glass specimen discussed above in accordance with ASTM D1894-14 are shown below in Table 1.

TABLE 1

STATIC COEFFICIENT OF FRICTION

| Sample No | Wilson ® NFL ® Leather Game Ball | Wilson ® NFL ® Leather Game Ball (ghosted) | % Change COF | Wilson ® GST ® Leather Game Ball | Wilson ® GST ® Leather Game Ball (ghosted) | % Change COF | Smooth Plate of Glass |
|---|---|---|---|---|---|---|---|
| 1 | 0.84 | 0.74 | 88.1% | 0.926 | 0.574 | 62.0% | 0.03 |
| 2 | 0.76 | 0.46 | 60.5% | 0.553 | 0.436 | 78.8% | |
| 3 | 0.88 | 0.53 | 60.2% | 0.814 | 0.494 | 60.7% | |
| Avg. | 0.83 | 0.58 | 69.9% | 0.764 | 0.501 | 65.6% | 0.03 |

The static coefficient of friction test results demonstrate a slight reduction in the coefficient of friction values of the specimens treated with the laser ghosting process compared to the specimens that were not treated with the laser ghosting process. The test specimens from the leather cover panels 28 of the first color (the NFL Samples) indicated a reduction in coefficient of friction values of approximately 30 percent from the specimens treated with the laser ghosting process compared to the specimens that were not treated with the laser ghosting process. The test specimens from the leather cover panels 28 of the second color (the GST Samples) indicated a reduction in coefficient of friction values of approximately 34 percent from the specimens treated with the laser ghosting process compared to the specimens that were not treated with the laser ghosting process. Accordingly, although the coefficient of friction values were slightly reduced with the laser ghosting treatment indicating a slight reduction in gripability, the reduction is small enough that it is not readily detectable by a player using the ball with ungloved hands.

The first and second portions 60 and 62 of the cover panels 28 have first and second static coefficient of friction values, respectively, when measured in accordance with the standard test method for static coefficient of friction of ASTM D1894-14. The static coefficient of friction values of the first portions 60 of the cover panels 28 treated with the laser ghosting process that are at least 60 percent of the static coefficient of friction values of the second portions 62 of the cover panels 28. Additionally, the static coefficient of friction of the test samples or specimens treated with the laser ghosting process were at least 65 percent of the static coefficient of friction of the test samples or specimens of not treated with the laser ghosting process.

In addition to measuring the static coefficient of friction values of leather cover panel test specimens treated with the laser ghosting process compared to leather cover panel test specimens not treated with the laser ghosting process, Applicant also obtained height measurements of the pebble-like projections 40 of the pebbled texture on the outer surface 38 of cover 12 or cover panels 22, 24, 26 and 28. Applicant worked with ATI of Bartlett, Ill. to measure the height of the pebble-like projections 40 on first portions of the cover 12 (or cover panel) having alphanumeric and/or graphical indicia 50 applied by the laser ghosting process and the height of pebble-like projections 40 on the second portions of the cover 12 or cover panels formed without the indicia 50 and not treated by the laser ghosting process. ATI utilized a Micro Vu Excel Automated Vision Measuring Machine produced by Micro-Vu Corporation of Windsor, Calif. to measure heights of the pebble-like projections. The accuracy of the height measurements using the Micro Vu Excel Automated Vision Measuring Machine is within 0.00009 inch.

Figure 24:
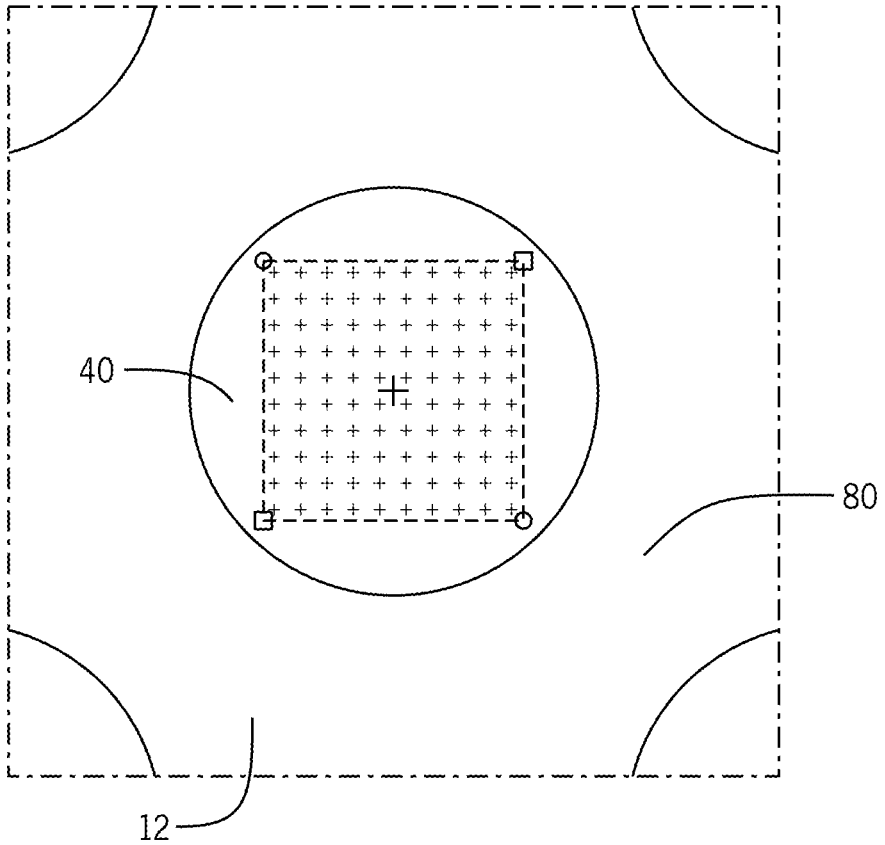
FIG. 24 is a close-up, top perspective view of a cover panel including a pebbled texture with a plurality of spaced apart pebble-like projections extending from a base region and illustrating the establishment of a base plane.
Figure 25:
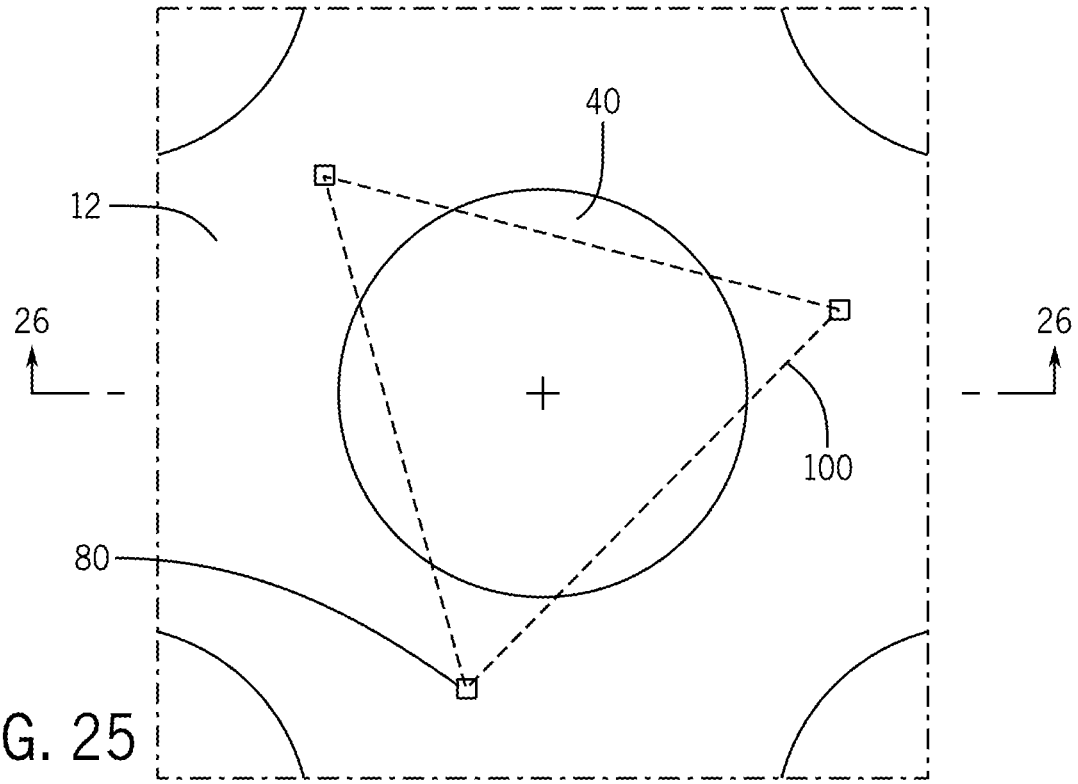
FIG. 25 is a close-up, top perspective view of a pebble-like projection with a representation of pebble-like projection height measurements taken on the top surface of one of the pebble-like projections.
Figure 26:
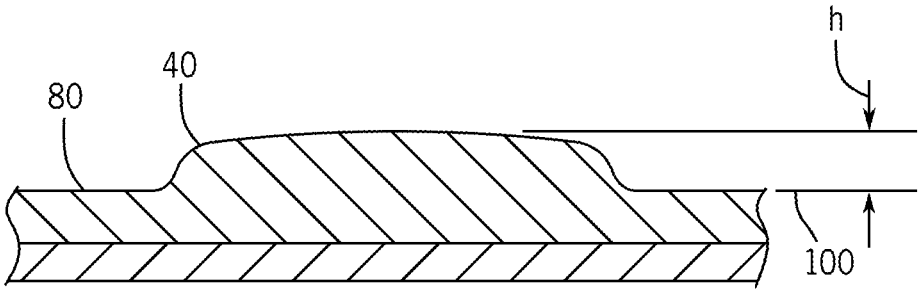
FIG. 26 is a cross-sectional side view of the portion of the cover panel of FIG. 24 illustrating the base plane and the measurement of the height of the pebble-like projection.

Referring to FIGS. 24 and 25, the process utilized with the Micro Vu Vision Measuring Machine included placing a cover panel 28 on a horizontal surface with the outer surface 38 of the cover panel 28 facing upward. Then, referring to FIG. 25, the relative position (or height) of three points within the valley 80 surrounding one of the pebble-like projections 40 were measured. The three measured points of the valley 80 are then used to define a base plane 100. Referring to FIG. 24, the maximum height of a selected pebble-like projection 40 is obtained by selecting a rectangular area on the top surface of the pebble-like projection 40. The Micro Vu Vision Measuring Machine then obtains dozens of position or height measurements of the selected rectangular area. Each height measurement is indicated by a plus sign "+". The largest value (greatest height) or relative distance between the base plane 100 and the dozens of pebble-like projection height measurements is selected as the maximum height of the pebble-like projection 40. Six pebble height measurements, as described above, were taken on each portion of cover panels. 6 measurements of pebble-like projections 40 on a first portion of a cover panel 28 of an NFL Sample having indicia 50 applied via the laser ghosting process were taken. 6 measurements of pebble-like projections 40 on a second portion of the cover panel 28 of the NFL Sample not having indicia 50 were taken. 6 measurements of pebble-like projections 40 on a first portion of a cover panel 28 of a GST Sample having indicia 50 applied via the laser ghosting process were taken. 6 measurements of pebble-like projections 40 on a second portion of the cover panel 28 of the GST Sample not having indicia 50 were taken. The results of the pebble-like projection height measurements are shown below in Table 2.

TABLE 2

HEIGHT OF PEBBLES ON NON-GHOSTED GAME BALL V. GHOSTED GAME BALL

| Sample No./ Measurement No. | Wilson ® NFL ® Leather Game Ball (in.) | Wilson ® NFL ® Leather Game Ball (ghosted) (in.) | Change in Pebble Height (in.) | % Pebble Height Change | Wilson ® GST ® Leather Game Ball (in.) | Wilson ® GST ® Leather Game Ball (ghosted) (in.) | Change in Pebble Height (in.) | % Pebble Height Change |
|---|---|---|---|---|---|---|---|---|
| 1/1 | 0.01592 | 0.01428 | | | 0.01259 | 0.01236 | | |
| 1/2 | 0.01625 | 0.01739 | | | 0.01170 | 0.01147 | | |
| 1/3 | 0.01632 | 0.01558 | | | 0.01108 | 0.01179 | | |
| 1/4 | 0.01809 | 0.01665 | | | 0.01113 | 0.01132 | | |
| 1/5 | 0.01774 | 0.01664 | | | 0.01229 | 0.01262 | | |
| 1/6 | 0.01535 | 0.01545 | | | 0.01178 | 0.01180 | | |
| Sample 1 Avg. | 0.01661 | 0.01600 | −0.00061 | −3.7% | 0.01176 | 0.01189 | +0.00013 | +1.1% |
| 2/1 | 0.01682 | 0.01491 | | | 0.01631 | 0.01365 | | |
| 2/2 | 0.01554 | 0.01691 | | | 0.01585 | 0.01559 | | |
| 2/3 | 0.01616 | 0.01517 | | | 0.01400 | 0.01530 | | |
| 2/4 | 0.01587 | 0.01539 | | | 0.01566 | 0.01641 | | |
| 2/5 | 0.01635 | 0.01583 | | | 0.01696 | 0.01431 | | |
| 2/6 | 0.01713 | 0.01663 | | | 0.01595 | 0.01558 | | |
| Sample 2 Avg. | 0.01631 | 0.01581 | −0.00050 | −3.1% | 0.01579 | 0.01514 | −0.00065 | −4.1% |
| 3/1 | 0.01483 | 0.01333 | | | 0.00873 | 0.01162 | | |
| 3/2 | 0.01467 | 0.01374 | | | 0.00827 | 0.01050 | | |
| 3/3 | 0.01379 | 0.01353 | | | 0.00985 | 0.01129 | | |
| 3/4 | 0.01324 | 0.01151 | | | 0.01048 | 0.01160 | | |
| 3/5 | 0.01314 | 0.01415 | | | 0.01020 | 0.01147 | | |
| 3/6 | 0.01389 | 0.01396 | | | 0.01004 | 0.01093 | | |
| Sample 3 Avg. | 0.01393 | 0.0134 | −0.00053 | −3.8% | 0.00960 | 0.01124 | +0.00164 | +14.6% |

The results of the height measurements of the pebble-like projections 40 shown in Table 2 above illustrate that the change in height of the pebble-like projections from those treated with the laser ghosting process to those not treated with the laser ghosting process is negligible or non-existent. A review of the change in height of the pebble-like projections 40 from the NFL Samples from pebble-like projection not treated with the laser ghosting process to those treated with the laser ghosting process is less than 4% (with average values of 3.7%, 3.1% and 3.8%), or change in height of 0.0005 inch. Accordingly, the height of the pebble-like projections 40 of the NFL Samples treated with the laser ghosting process are at least 96% of the height of the pebble-like projections 40 of the NFL Samples not treated with the laser ghosting process. Additionally, a review of the change in height of the pebble-like projections 40 from the GST Samples from pebble-like projection not treated with the laser ghosting process to those treated with the laser ghosting process shows no overall reduction. In fact, the average height of the pebble-like projections of 2 of the GST Samples treated with the laser ghosting process were actually greater than the average height of the pebble-like projections of the portions of the GST Samples not treated with the laser ghosting process, and the third GST Sample resulted in a height measurement decrease of 4.1%. The average change in height of the pebble like projection from treated to non-treated is 0.00037 inch (in an increased direction). Accordingly, the height of the pebble-like projections 40 of the GST Samples treated with the laser ghosting process on average was no less than the height of the pebble-like projections 40 of the GST Samples not treated with the laser ghosting process.

Importantly, the application of alphanumeric and/or graphical indicia 50 to the cover panels of leather cover panels using the laser ghosting process results in an insignificant change in the height of the pebble-like projections 40. The change in height due to the application of the indicia 50 using the laser ghosting process has a negligible or no effect on the height of the pebble-like projections. In contrast, as stated above, the application of conventional laser or thermal branding techniques for applying indicia result in entire removal of pebble-like projections and additionally further removal of material such that recesses 82 are formed in the cover panels. The recesses are at least 0.005 inch with measured values of 0.00803, 0.00935 and 0.00987 inch. The application of the laser ghosting process retains the pebble-like projection to at least 96% of its original height (or greater). Conventional laser or branding eliminates or destroys the pebble-like projections entirely and also extends further inward removing or destroying additional material by a dimension that is an order of magnitude greater than the dimension of the change in height of the pebble-like projections due to the laser ghosting process.

Accordingly, at least a first portion of the cover 12 can include alphanumeric and/or graphical indicia 50 applied by the laser ghosting process. A second portion of the cover can be formed without the indicia 50. The average pebble height of a plurality of the pebble-like projections in the first portion of the cover is at least 80 percent of the average height of a plurality of the pebble-like projections in the second portion of the cover. In another implementation, the average pebble height of a plurality of the pebble-like projections in the first portion of the cover can be at least 90 percent of the average height of a plurality of the pebble-like projections in the second portion of the cover. In another implementation, the average pebble height of a plurality of the pebble-like projections in the first portion of the cover can be at least 95 percent of the average height of a plurality of the pebble-like projections in the second portion of the cover.

Figure 14:
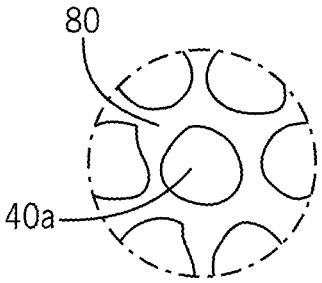
FIGS. 14 through 23 are close-up top views of the outer surface of cover panels of game balls having pebble-like projections with different shaped projections.
Figure 15:
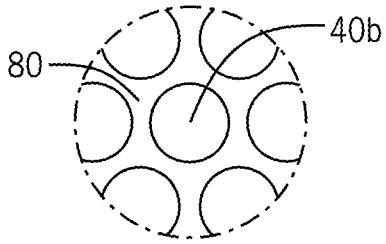
Figure 16:
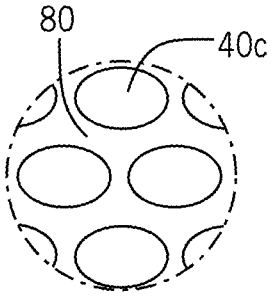
Figure 17:
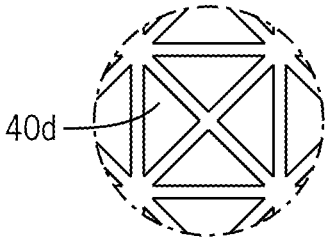
Figure 18:
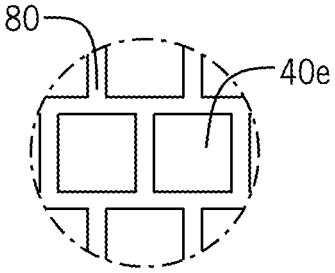
Figure 19:
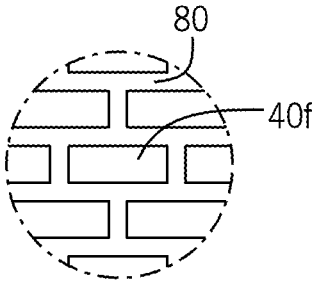
Figure 20:
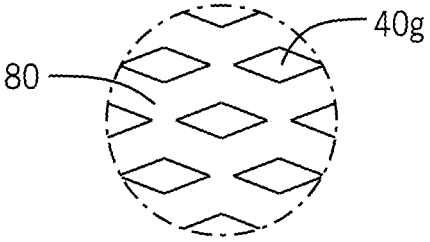
Figure 21:
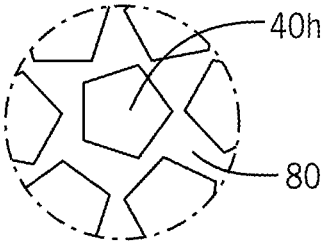
Figure 22:
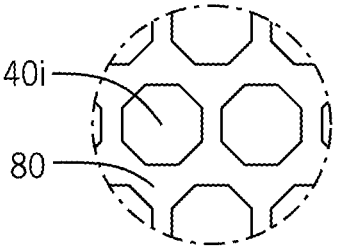
Figure 23:
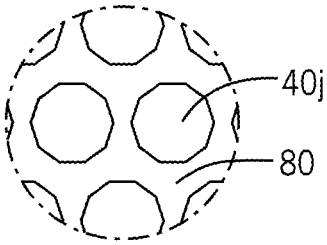

Referring to FIGS. 14 through 23, the pebble-like projections 40 can take a variety of different shapes, including, for example, a partially spherical shape, a hemi-spherical shape, a generally oval-shape, a generally polygonal-shape, a frusto-conical shape, a conical shape, a pyramid shape, a cylindrical shape, a truncated pyramid shape, a cubic shape, other irregular-shapes, and combinations thereof. Referring to FIG. 14, a pebble-like projection 40*a* can have an irregular rounded shape. Referring to FIG. 15, a pebble-like projection 40*b* can have a circular shape. Referring to FIG. 16, a pebble-like projection 40*c* can have an oval or elliptical shape. Referring to FIG. 17, a pebble-like projection 40*d* can have a triangular shape. Referring to FIG. 18, a pebble-like projection 40*e* can have a triangular shape. Referring to FIG. 19, a pebble-like projection 40*f* can have a triangular shape. Referring to FIG. 20, a pebble-like projection 40*g* can have a triangular shape. Referring to FIGS. 21 through 23 in other implementations, the pebble-like projections can take other polygonal shapes, such as, for example, a pebble-like projection 40*h* can have a pentagonal shape, a pebble-like projection 40*i* can have a hexagonal shape, and a pebble-like projection 40*j* can have an octagonal shape. In other implementations, combinations of the pebble-like projections 40*a* through 40*j* can be used.

While the preferred implementations of the present invention have been described and illustrated, numerous departures therefrom can be contemplated by persons skilled in the art. Therefore, the present invention is not limited to the foregoing description but only by the scope and spirit of the appended claims.

What is claimed is:

1. An inflatable game ball configured for direct contact with a user's hands, the game ball comprising:

a flexible, resilient cover formed of a natural leather and having an outer surface, the outer surface of the cover including a pebbled texture, the pebbled texture including a plurality of spaced apart pebble-like projections extending from a base region, each of the pebble-like projections having a pebble height measured from the base region adjacent to the pebble-like projection to a top surface of the pebble-like projection, at least a first portion of the cover including alphanumeric and/or graphical indicia applied by a laser ghosting process, and a second portion of the cover being formed without the indicia, the average pebble height of a plurality of the pebble-like projections in the first portion of the cover being at least 80 percent of the average height of a plurality of the pebble-like projections in the second portion of the cover, wherein the first and second portions of the cover have first and second static coefficient of friction values, respectively, when measured in accordance with the standard test method for static coefficient of friction of ASTM D1894-14, and wherein the static coefficient of friction value of the first portion of the cover is at least 60 percent of the static coefficient of friction value of the second portion.

2. The game ball of claim 1, wherein the average pebble height of a plurality of the pebble-like projections in the first portion of the cover being at least 90 percent of the average height of a plurality of the pebble-like projections in the second portion of the cover.

3. The game ball of claim 1, wherein the average pebble height of a plurality of the pebble-like projections in the first portion of the cover being at least 95 percent of the average height of a plurality of the pebble-like projections in the second portion of the cover.

4. The game ball of claim 1, wherein the game ball is an American-style football.

5. The game ball of claim 4, wherein the football includes an inflatable bladder, wherein the cover includes four cover panels coupled together and surrounding the bladder, and wherein the graphical and/or alphanumeric indicia extends over at least one of the four cover panels.

6. The game ball of claim 5 wherein the graphical and/or alphanumeric indicia extends over at least two of the four cover panels.

7. The game ball of claim 1, wherein the plurality of pebble-like projections consist of at least one shape selected from the group consisting of irregularly-shaped pebble-like projections, hemi-spherically-shaped projections, generally oval-shaped projections, generally triangular-shaped projections, generally square-shaped projections, generally rectangular-shaped projections, generally diamond-shaped projections, generally pentagon-shaped projections, other polygonal-shaped projections, and combinations thereof.

8. The game ball of claim 1, wherein the average pebble height of a plurality of pebble-like projections of the first and second portions of the cover is at least 0.006 inch.

9. The game ball of claim 1, wherein the average pebble height of a plurality of pebble-like projections of the first and second portions of the cover is within the range of 0.004 to 0.0275 inch.

10. The game ball of claim 5, wherein each of the cover panels has an outer surface area, and wherein the first portion of the cover including alphanumeric and/or graphical indicia extends over at least one third of the outer surface area of at least one of the cover panels.

11. The game ball of claim 5, wherein each of the cover panels has an outer surface area, and wherein the first portion of the cover including alphanumeric and/or graphical indicia extends over at least one half of the outer surface area of at least one of the cover panels.

12. The game ball of claim 5, wherein each of the cover panels has an outer surface area, and wherein the first portion of the cover including alphanumeric and/or graphical indicia extends over at least two thirds of the outer surface area of at least one of the cover panels.

13. An American-style football configured for direct contact with a user's hands, the football comprising:

an inflatable prolate spheroidal shaped bladder;

a lining positioned over the bladder;

a cover assembly including at least first, second, third and fourth flexible, resilient cover panels collectively positioned over the bladder and the lining, the cover panels being formed of a natural leather and having an outer surface, the outer surface of the cover including a pebbled texture, the cover assembly further including a first portion having alphanumeric and/or graphical indicia applied by a laser ghosting process, and a second portion being formed without the indicia, the first and second portions of the cover assembly having first and second static coefficient of friction values, respectively, when measured in accordance with the standard test method for static coefficient of friction of ASTM D1894-14, the static coefficient of friction value of the first portion of the cover assembly being at least 60 percent of the static coefficient of friction value of the second portion; and a lacing coupled to the first and fourth cover panels.

14. The American-style football of claim 13, wherein the pebbled texture includes a plurality of spaced apart pebble-like projections extending from a base region, each of the pebble-like projections having a pebble height measured from the base region adjacent to the pebble-like projection to a top surface of the pebble-like projection.

15. The American-style football of claim 14, wherein the average pebble height of a plurality of the pebble-like projections in the first portion of the cover assembly is at least 80 percent of the average height of a plurality of the pebble-like projections in the second portion of the cover assembly.

16. The American-style football of claim 14, wherein the average pebble height of a plurality of the pebble-like projections in the first portion of the cover assembly is at least 90 percent of the average height of a plurality of the pebble-like projections in the second portion of the cover assembly.

17. The American-style football of claim 13, wherein the graphical and/or alphanumeric indicia extends over at least one of the four cover panels.

18. The American-style football of claim 13, wherein the graphical and/or alphanumeric indicia extends over at least two of the four cover panels.

19. The American-style football of claim 13, wherein the average pebble height of a plurality of pebble-like projections of the first and second portions of the cover assembly is at least 0.006 inch.

20. The American-style football of claim 13, wherein the average pebble height of a plurality of pebble-like projections of the first and second portions of the cover is within the range of 0.004 to 0.0275 inch.

21. The American-style football of claim 13, further including at least two stripes coupled to the first and fourth cover panels.

22. The American-style football of claim 13, wherein the plurality of pebble-like projections consist of at least one shape selected from the group consisting of irregularly-shaped pebble-like projections, hemi-spherically-shaped projections, generally oval-shaped projections, generally triangular-shaped projections, generally square-shaped projections, generally rectangular-shaped projections, generally diamond-shaped projections, generally pentagon-shaped projections, other polygonal-shaped projections, and combinations thereof.

23. The American-style football of claim 13, wherein each of first, second, third and fourth cover panels has an outer surface area, and wherein the first portion of including alphanumeric and/or graphical indicia extends over at least one half of the outer surface area of at least one of the first, second, third and fourth cover panels.

24. The inflatable game ball of claim 1, wherein the first portion of the cover is uncovered and configured for direct contact by the user's hands.

25. The American-style football of claim 13, wherein the first portion of the cover assembly is uncovered and configured for direct contact by the user's hands.

* * * * *